US011019848B2

(12) United States Patent
Rojo-Calderon

(10) Patent No.: US 11,019,848 B2
(45) Date of Patent: Jun. 1, 2021

(54) INDUCTIVE HEATING DEVICE FOR HEATING AN AEROSOL-FORMING SUBSTRATE COMPRISING A SUSCEPTOR

(71) Applicant: PHILIP MORRIS PRODUCTS S.A., Neuchatel (CH)

(72) Inventor: Noelia Rojo-Calderon, Neuchatel (CH)

(73) Assignee: PHILIP MORRIS PRODUCTS S.A., Neuchatel (CH)

( * ) Notice: Subject to any disclaimer, the term of this patent is extended or adjusted under 35 U.S.C. 154(b) by 272 days.

(21) Appl. No.: 15/768,855

(22) PCT Filed: Oct. 21, 2016

(86) PCT No.: PCT/EP2016/075314
§ 371 (c)(1),
(2) Date: Apr. 17, 2018

(87) PCT Pub. No.: WO2017/068098
PCT Pub. Date: Apr. 27, 2017

(65) Prior Publication Data

US 2019/0053541 A1 Feb. 21, 2019

(30) Foreign Application Priority Data

Oct. 22, 2015 (EP) ..... 15190939

(51) Int. Cl.
*A24F 47/00* (2020.01)
*A24D 1/00* (2020.01)
(Continued)

(52) U.S. Cl.
CPC ..... *A24F 47/008* (2013.01); *A24D 1/002* (2013.01); *A24D 1/14* (2013.01); *H05B 6/108* (2013.01)

(58) Field of Classification Search
CPC ..... A24F 40/465; A24F 40/46
See application file for complete search history.

(56) References Cited

U.S. PATENT DOCUMENTS 5,613,505 A * 3/1997 Campbell ..... A24F 47/008 131/194
5,649,554 A 7/1997 Sprinkel
2014/0270729 A1* 9/2014 DePiano ..... A24F 47/008 392/397

FOREIGN PATENT DOCUMENTS

CN 1126426 A 7/1996
CN 1183020 A 5/1998
(Continued)

OTHER PUBLICATIONS

PCT Search Report and Written Opinion for PCT/EP2016/075314 dated Feb. 7, 2017 (12 pages).
(Continued)

*Primary Examiner* — Eric Yaary
*Assistant Examiner* — Jennifer A Kessie
(74) *Attorney, Agent, or Firm* — Oblon, McClelland, Maier & Neustadt, L.L.P.

(57) ABSTRACT

An inductive heating device for heating an aerosol-forming substrate including a susceptor includes a device housing having a cavity with an internal surface shaped to accommodate at least a portion of the aerosol-forming substrate, a coil arranged to surround at least a portion of the cavity, an electrical power source, and power supply electronics connected to the electrical power source and to the coil, for supplying an alternating current to the coil. The coil is a single coil having a plurality of connection taps arranged at different locations along the coil length to divide the single coil into a plurality of individual coil segments. The power supply electronics individually supply the alternating current to each individual coil segment.

5 Claims, 4 Drawing Sheets

(51) Int. Cl.
*A24D 1/14* (2006.01)
*H05B 6/10* (2006.01)

(56) References Cited

FOREIGN PATENT DOCUMENTS

| | | | |
|---|---|---|---|
| CN | 203762288 | U | 8/2014 |
| CN | 104095293 | A | 10/2014 |
| CN | 104095293 | | 8/2016 |
| EP | 0488488 | | 7/1994 |
| GB | 2504732 | | 1/2015 |
| JP | 08-511175 | A | 11/1996 |
| JP | 2002-529906 | A | 9/2002 |
| JP | 2014-525251 | A | 9/2014 |
| WO | WO 95/27411 | | 10/1995 |

OTHER PUBLICATIONS

Notification of the First Office Action (PCT Application in the National Phase) dated Apr. 23, 2020 in corresponding Chinese Patent Application No. 201680060367.X (English translation)(11 pages).
Japanese Office Action dated Oct. 15, 2020 in Japanese Patent Application No. P2018-520477, (submitting English translation only), 2 pages.
Chinese Office Action dated Dec. 11, 2020 in Chinese Patent Application No. 201680080367.X, (submitting English translation only), 15 pages.

* cited by examiner

INDUCTIVE HEATING DEVICE FOR HEATING AN AEROSOL-FORMING SUBSTRATE COMPRISING A SUSCEPTOR

BACKGROUND

The present invention relates to an inductive heating device for heating an aerosol-forming substrate comprising a susceptor, and more particularly relates to an inductive heating device for heating an aerosol-forming article.

Previously known more conventional smoking articles, for example cigarettes, deliver flavor and aroma to the user as a result of a combustion process. A mass of combustible material, primarily tobacco, is combusted and an adjacent portion of material is pyrolized as the result of applied heat drawn therethrough, with typical combustion temperatures being in excess of 800° C. during puffing. During this heating, inefficient oxidation of the combustible material takes place and yields various distillation and pyrolysis products. As these products are drawn through the body of the smoking article towards the mouth of the user, they cool and condense to form an aerosol or vapor which gives the consumer the flavor and aroma associated with smoking.

Alternatives to the more conventional smoking articles include those in which the combustible material itself does not directly provide the flavorants to the aerosol inhaled by the user. In these articles, a combustible heating element, typically carbonaceous in nature, is combusted to heat air as it is drawn over the heating element and through a zone which contains heat-activated elements that release the flavored aerosol.

Yet another alternative to the more conventional smoking articles are aerosol-forming articles comprising an aerosol-forming tobacco-laden solid substrate comprising a magnetically permeable and electrically conductive susceptor which is arranged in thermal proximity to the aerosol-forming tobacco-laden substrate. The susceptor of the tobacco-laden substrate is exposed to an alternating magnetic field generated by an induction source, for example a coil, so that an alternating magnetic field is induced in the susceptor.

This induced alternating magnetic field generates heat in the susceptor, and at least some of this heat generated in the susceptor is transferred from the susceptor to the aerosol-forming substrate arranged in thermal proximity to the susceptor to produce the aerosol and evolve the desired flavor.

For that purpose, the entire tobacco-laden substrate is typically heated during the whole duration of the consuming run. Due to the tobacco flavor compounds and possibly additional other flavor compounds of the tobacco-laden substrate in the immediate spatial vicinity of the susceptor being aerosolized first (as the temperature of the tobacco-laden substrate in the immediate vicinity of the susceptor is highest) and thus being depleted first, the power supplied to the coil is typically controlled towards an increase in temperature of the susceptor over the duration of the consuming run so as to also enable aerosolization of those tobacco flavor compounds and possibly additional other flavor compounds of the tobacco-laden substrate not located in the immediate vicinity of the susceptor.

Alternatively, different segments of the tobacco-laden substrate are heated sequentially, so that during each puff a "fresh" (non-depleted) portion of the tobacco-laden substrate is heated. This is achieved, for example, with the aid of a plurality of separate individual coils which are arranged along a cavity accommodating a rod of a solid tobacco-laden substrate, the respective separate coils surrounding different portions of the rod of solid tobacco-laden substrate along the length of the rod of solid tobacco-laden substrate, respectively. The separate individual coils are sequentially supplied with an alternating current to sequentially generate an alternating magnetic field in the respective portion of the cavity surrounded by respective individual separate coil and, as a consequence, in the susceptor in the different segments of the rod of solid tobacco-laden substrate, thus sequentially heating the different segments of the rod of solid tobacco-laden substrate.

However, due to the coils being individual separate coils the properties of the individual separate coils influencing the heating of the susceptor (e.g. inductance) may vary to some extent, so that the individual segments of the rod of tobacco-laden substrate may not be heated uniformly, which in turn may result in a non-uniform aerosolization of the tobacco flavor compounds and possibly additional flavor compounds of the tobacco-laden substrate, and thus may result in a non-uniform consuming experience. Also, the individual separate coils have to be arranged precisely axially aligned relative to each other to produce homogeneous alternating magnetic fields in the different segments of the rod of the solid tobacco-laden substrate.

Therefore, there is a need for an improved induction heating device for aerosol-forming substrates comprising a susceptor, more particularly for solid aerosol-forming substrates including a susceptor, for example solid aerosol-forming substrates of an aerosol-forming article.

BRIEF SUMMARY

In accordance with one aspect of the invention an inductive heating device for heating an aerosol-forming article comprising a susceptor is suggested. The inductive heating device comprises:

- a device housing comprising a cavity having an internal surface shaped to accommodate at least a portion of the aerosol-forming article,
- a coil arranged to surround at least a portion of the cavity
- an electrical power source, and
- a power supply electronics connected to the electrical power source and to the coil, for supplying an alternating current to the coil to generate in the portion of the cavity surrounded by the coil an alternating magnetic field suitable to heat the susceptor.

The coil is a single coil having a coil length and a plurality of connection taps which are arranged at different locations along the coil length to divide the single coil into a plurality of individual coil segments, the connection taps being connected to the power supply electronics.

The power supply electronics is configured to be capable of individually supplying the alternating current to each individual coil segment of the plurality of coil segments, to generate the alternating magnetic field in that portion of the cavity surrounded by the respective individual coil segment supplied with the alternating current.

The single coil having the plurality of connection taps arranged at different locations along the coil length is advantageous as the coil is manufactured as a single piece from the same material and, accordingly, the properties of the single coil influencing the heating of the susceptor (e.g. inductance) practically do not vary when the single coil is properly manufactured.

The power source generally may comprise any suitable power source including in particular a power supply unit to be connected to the mains, one or more single-use batteries, rechargeable batteries, or any other suitable power source capable of providing the required supply voltage and the required supply amperage. In particular, the power source may comprise rechargeable batteries.

While generally the power supply electronics can be embodied in any suitable manner, it typically may comprise a microcontroller for controlling the amperage, frequency, duration, etc. of the alternating current supplied to the respective taps of the respective individual coil segment or segments surrounding the respective portion or portions of the aerosol-forming article in the cavity. In mass production, the power supply electronics may typically be configured (for example embodied and programmed) to supply the same alternating current of predetermined amperage and frequency to the individual coil segments, although this is not mandatory. However, in any event the power supply electronics is configured in a manner such that for each individual coil segment of the single coil the amperage and frequency of the alternating current supplied to each individual coil segment is predetermined and selected to generate an amount of heat sufficient to cause aerosolization of at least some compounds of the aerosol-forming article which, by way of example, may be an aerosol-forming article comprising a solid tobacco-laden substrate. The result is a uniform aerosolization of the tobacco flavor compounds and possibly additional flavor compounds of the tobacco-laden substrate during the consuming run, which in turn results in a uniform consuming experience.

Generally, the power supply electronics is capable of separately and sequentially supplying the alternating current to each individual coil segment of the single coil through the connection taps of the individual coil segments, however, it is not mandatory that the individual coil segments be separately and sequentially supplied with the alternating current one after the other. Also, even in case the individual coil segments of the single coil are separately and sequentially supplied with the alternating current one after the other, then the sequence of the supply of alternating current does not have to be identical with the sequence of the arrangement of the individual coil segments along the cavity. For example, that individual coil segment located at the distal end of the cavity can be supplied with the alternating current first, and thereafter the alternating current can be supplied to that individual coil segment located at the proximal end of the cavity. Thereafter, the individual coil segment next to that coil segment located at the distal end can be supplied with the alternating current, whereupon the individual coil segment next to that coil segment located at the proximal end can be supplied with the alternating current, and so on. However, any other sequence of supplying the alternating current to the individual coil segments of the single coil is considered to be within the scope of the present invention.

Also, it is well within the scope of the present invention that the alternating current be supplied to two or more individual coil segments of the single coil at the same time. After a predetermined duration, the alternating current may then be supplied to either one single individual coil segment other than the coil segments previously supplied with the alternating current, or the alternating current is supplied again to two or more coil segments other than the coil segments previously supplied with the alternating current. Again, any sequence of supplying the two or more individual coil segments is considered to be well within the scope of the present invention.

By way of example, supplying the alternating current to only one individual coil segment of the plurality of coil segments of the single coil can be achieved as follows. The power supply electronics supplies the alternating current through the two connection taps at the distal and proximal ends of the respective individual coil segment to which the alternating current is to be supplied, while the connection taps of the other individual coil segments located upstream and downstream of the individual coil segment to which the alternating current is supplied are electrically short-cut with the respective distal and proximal connection tap of the individual coil segment through which the alternating current is supplied. Accordingly, no alternating current may flow through the other individual coil segments located upstream and downstream of that individual coil segment to which the alternating current is supplied. This is similarly applicable in case the alternating current is to be supplied to two or more individual coil segments of the single coil at the same time.

The aerosol-forming substrate is preferably a substrate capable of releasing volatile compounds that can form an aerosol. The volatile compounds are released by heating the aerosol-forming substrate. In a preferred embodiment, the aerosol-forming substrate is solid.

The aerosol-forming substrate may comprise nicotine. The nicotine containing aerosol-forming substrate may be a nicotine salt matrix. The aerosol-forming substrate may comprise plant-based material. The aerosol-forming substrate may comprise tobacco, and preferably the tobacco containing material contains volatile tobacco flavor compounds, which are released from the aerosol-forming substrate upon heating.

The aerosol-forming substrate may comprise homogenized tobacco material. Homogenized tobacco material may be formed by agglomerating particulate tobacco. Where present, the homogenized tobacco material may have an aerosol-former content of equal to or greater than 5% on a dry weight basis, and preferably between greater than 5% and 30% by weight on a dry weight basis.

The aerosol-forming substrate may alternatively comprise a non-tobacco-containing material. The aerosol-forming substrate may comprise homogenized plant-based material.

The aerosol-forming substrate may comprise at least one aerosol-former. The aerosol-former may be any suitable known compound or mixture of compounds that, in use, facilitates formation of a dense and stable aerosol and that is substantially resistant to thermal degradation at the operating temperature of the aerosol-generating device. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Particularly preferred aerosol formers are polyhydric alcohols or mixtures thereof, such as triethylene glycol, 1,3-butanediol and, most preferred, glycerine. The aerosol-forming substrate may comprise other additives and ingredients, such as flavorants. The aerosol-forming substrate preferably comprises nicotine and at least one aerosol-former. In a particularly preferred embodiment, the aerosol-former is glycerine.

The term 'susceptor' refers to a material that is capable to convert electromagnetic energy into heat. When located in an alternating electromagnetic field, typically eddy currents are induced and hysteresis losses occur in the susceptor causing heating of the susceptor. As the susceptor is located in thermal contact or close thermal proximity with the aerosol-forming substrate, the aerosol-forming substrate is heated by the respective susceptor such that an aerosol is formed. Preferably, the susceptor is arranged in direct physical contact with the respective sources.

The susceptor may be formed from any material that can be inductively heated to a temperature sufficient to aerosolize the aerosol-forming substrate. Preferred susceptors comprise a metal or carbon. A preferred susceptor may comprise or consist of a ferromagnetic material, for example ferritic iron, a ferromagnetic alloy, such as ferromagnetic steel or stainless steel, ferromagnetic particles, and ferrite. A suitable susceptor may be, or comprise, aluminum. The susceptor preferably comprises more than 5%, preferably more than 20%, preferably more than 50% or 90% of ferromagnetic or paramagnetic materials. Preferred susceptors may be heated to a temperature in excess of 250 degrees Celsius.

Suitable susceptors may comprise a non-metallic core with a metal layer disposed on the non-metallic core, for example metallic tracks formed on a surface of a ceramic core. A susceptor may have a protective external layer, for example a protective ceramic layer or protective glass layer encapsulating the susceptor. The susceptor may comprise a protective coating formed by a glass, a ceramic, or an inert metal, formed over a core of susceptor material.

The susceptor may comprise a metallic elongate material. The susceptor may also comprise particles, for example metal or ferrite particles. In case the susceptor is in the form of a plurality of particles, preferably the particles are homogeneously distributed in the aerosol-forming substrate. Preferably, the susceptor particles have sizes in a range of 5 micrometers to 100 micrometers, more preferably in a range of 10 micrometers to 80 micrometers, for example between 20 micrometers and 50 micrometers.

The susceptor may be solid, hollow or porous. Preferably, the susceptor is solid. The susceptor may have continuous profile which is a filament, a rod, a sheet or a band.

If the susceptor profile is of constant cross-section, for example circular cross-section, it has a preferable width or diameter of between 1 millimeter and 5 millimeters. If the susceptor profile has the form of a sheet or band, the sheet or band preferably has a rectangular shape having a width preferably between 2 millimeters and 8 millimeters, more preferably between 3 millimeters and 5 millimeters, for example 4 millimeters, and has a thickness preferably between 0.03 millimeter and 0.15 millimeter, more preferably between 0.05 millimeter and 0.09 millimeter, for example 0.07 millimeter.

By way of example, in case of a rod-shaped solid tobacco-laden aerosol-forming substrate the susceptor may be in the form of particles distributed within the aerosol-forming substrate, or may be in the form of strips arranged at predetermined locations and extend transverse to, in particular perpendicular to, the direction of the length of the rod, or may be in the form of strands extending through the rod in the direction of the length of the rod.

The inductive heating device according to the invention may or may not comprise a mouthpiece. For example, in case the inductive heating device does not comprise a mouthpiece, the aerosol-forming substrate may be embodied as a rod-shaped solid tobacco-laden substrate which is provided with a filter. The rod-shaped solid tobacco-laden substrate (including the susceptor) may be inserted in the cavity of the device with the filter projecting outward from the cavity, so that during the consuming run the consumer may draw at the filter end of the substrate. Alternatively, the device may comprise a mouthpiece, and in this case the aerosol-forming substrate may be fully enclosed by the inductive heating device, so that during the consuming run the consumer may draw at the mouthpiece. Any of these embodiments (with or without mouthpiece) is considered to be within the scope of the invention.

In accordance with one aspect of the inductive heating device according to the invention, the power supply electronics is configured to sequentially supply the alternating current to the individual coil segments in the same sequence the individual coil segments are arranged along the cavity.

For example, the alternating current can first be supplied to the individual coil segment located at the distal end of the cavity, thereafter to that individual coil segment located next to the individual coil segment located at the distal end, and so on, until the alternating current is supplied to that individual coil segment located at the proximal end of the cavity. Alternatively, the alternating current can first be supplied to the individual coil segment located at the proximal end of the cavity, thereafter to that individual coil segment located next to the individual coil segment located at the proximal end, and so on, until the alternating current is supplied to that individual coil segment located at the distal end of the cavity.

The sequential supply of the alternating current to the individual coil segments in the same sequence the individual coil segments are arranged along the cavity is advantageous in that the segment of the aerosol-forming article located next to that individual coil segment to which the alternating current is supplied right now may also get pre-heated to a temperature below the temperature for forming the aerosol although the individual coil segment (due to being located close to that segment of the aerosol-forming substrate which is surrounded by that individual coil segment to which the alternating current is supplied right now), so that once this next segment of the aerosol-forming article is to be heated by supplying the alternating current through the individual coil segment surrounding this segment of the aerosol-forming article it can be very quickly heated to the desired temperature at which the aerosol is formed.

In accordance with a further aspect of the inductive heating device according to the invention, the power supply electronics is configured to supply the alternating current to a preceding individual coil segment of the sequence and to thereafter supply the alternating current to a subsequent individual coil segment of the sequence, and wherein the power electronics is further configured to start supplying the alternating current to the subsequent individual coil segment of the sequence while continuing to supply the alternating current to the preceding individual coil segment of the sequence, so that there is an overlapping time interval during which the alternating current is supplied to both the preceding individual coil segment and the subsequent individual coil segment of the sequence.

The overlapping time interval during which the alternating current is applied to both the preceding individual coil segment of the sequence and the subsequent individual coil segment of the sequence may further improve the heating of the subsequent segment of the aerosol-forming article aforedescribed effect, as the continued heating of the preceding segment of the aerosol-forming article may contribute to a more rapid heating of the subsequent segment of the aerosol-forming article to a temperature at which the aerosol is formed.

By way of example only, in case of a rod-shaped solid tobacco-laden substrate of an aerosol-forming article the single coil may comprise three individual coil segments arranged in sequence along the cavity. Assuming that the entire consuming run has a duration of six minutes, the first individual coil segment of the single coil is supplied with the alternating current for two minutes. After these first two minutes the second individual coil segment of the single coil is supplied with the alternating current for another two minutes (i.e. for the third and fourth minute counted from the start of the consuming run), and thereafter the third individual coil segment is supplied with the alternating current for yet another two minutes. The overlapping time interval (during which two adjacently arranged individual coil segments are both supplied with the alternating current) may have a duration of thirty seconds.

Another subject of the invention is an aerosol delivery system. The aerosol delivery system comprises:

an inductive heating device according to the invention as described above, and an aerosol-forming article comprising a susceptor and having a size allowing at least a portion of the aerosol-forming article to be accommodated in the cavity of the inductive heating device.

During operation of the system at least a portion of the aerosol-forming article is accommodated in the cavity of the inductive heating device such that the individual segments of the single coil are inductively coupled to the susceptor.

With respect to the advantages of the aerosol delivery system according to the invention it is referred to the advantages of the inductive heating device according to the invention.

According to one aspect of the aerosol delivery system according to the invention the aerosol-forming article may be an aerosol-forming article comprising a tobacco-laden solid aerosol-forming substrate.

As is already mentioned above, in accordance with one particular aspect of the aerosol delivery system according to the invention the tobacco-laden solid aerosol-forming substrate has the shape of a rod. The internal surface of the cavity of the inductive heating device is sized and shaped to accommodate the rod of the tobacco-laden aerosol-forming substrate. This aspect allows for an easy insertion of the rod-shaped solid tobacco-laden substrate of the aerosol-forming article into the cavity in order to make the system ready to use.

As also mentioned above already, in accordance with yet a further aspect of the aerosol delivery system according to the invention the susceptor comprises susceptor particles distributed in the tobacco-laden solid aerosol-forming substrate. The susceptor particles distributed in the solid tobacco-laden substrate allow for a uniform heating of the solid tobacco-laden aerosol-forming substrate over the entire length of the substrate in the respective segment of the substrate surrounded by the individual coil segment to which the alternating current is supplied.

In accordance with another aspect of the aerosol delivery system according to the invention the susceptor comprises susceptor strips which are arranged within the rod of solid tobacco-laden aerosol-forming substrate equidistantly spaced along the length of the rod and which extend in a direction transverse to, preferably perpendicular to, the length of the rod. This allows for a targeted heating of the rod of solid tobacco-laden substrate at the locations where the susceptor strips are arranged along the length of the rod. If the susceptor strips are arranged at small distances relative to each other it is possible to achieve a very uniform heating of the rod of tobacco-laden substrate in the respective portions of the rod of tobacco-laden substrate which are surrounded by the respective individual coil segment to which the alternating current is supplied.

Yet another subject of the invention is a method of operating an aerosol delivery system according to the invention as described above. The method comprises the steps of:

inserting at least a portion of the aerosol-forming article comprising the susceptor into the cavity of the inductive heating device such that the individual segments of the single coil are capable of being inductively coupled to the susceptor of the aerosol-forming article, supplying the alternating current to the individual coil segments of the plurality of coil segments with the aid of the power supply electronics to generate the alternating magnetic field to inductively heat the aerosol-forming article in that portion surrounded by the respective individual coil segment supplied with the alternating current.

In accordance with one aspect of the method according to the invention, supplying the alternating current to the individual coil segments comprises sequentially supplying the alternating current to the individual coil segments in the same sequence the individual coil segments are arranged along the cavity.

In accordance with a further aspect of the method according to the invention, the alternating current is supplied to a preceding individual coil segment of the sequence and thereafter the alternating current is supplied to a subsequent individual coil segment of the sequence. Supplying the alternating current to the subsequent individual coil segment of the sequence is started while continuing to supply the alternating current to the preceding individual coil segment of the sequence, so that there is an overlapping time interval during which the alternating current is supplied to both the preceding individual coil segment and the subsequent individual coil segment of the sequence.

Still in accordance with another aspect of the method according to the invention, the aerosol-forming article inserted into the cavity of the inductive heating device is a an aerosol-forming article comprising a solid tobacco-laden substrate.

BRIEF DESCRIPTION OF THE DRAWINGS

Further advantageous aspects of the invention will become apparent from the following description of embodiments with the aid of the drawings in which.

DETAILED DESCRIPTION

Figure 1:
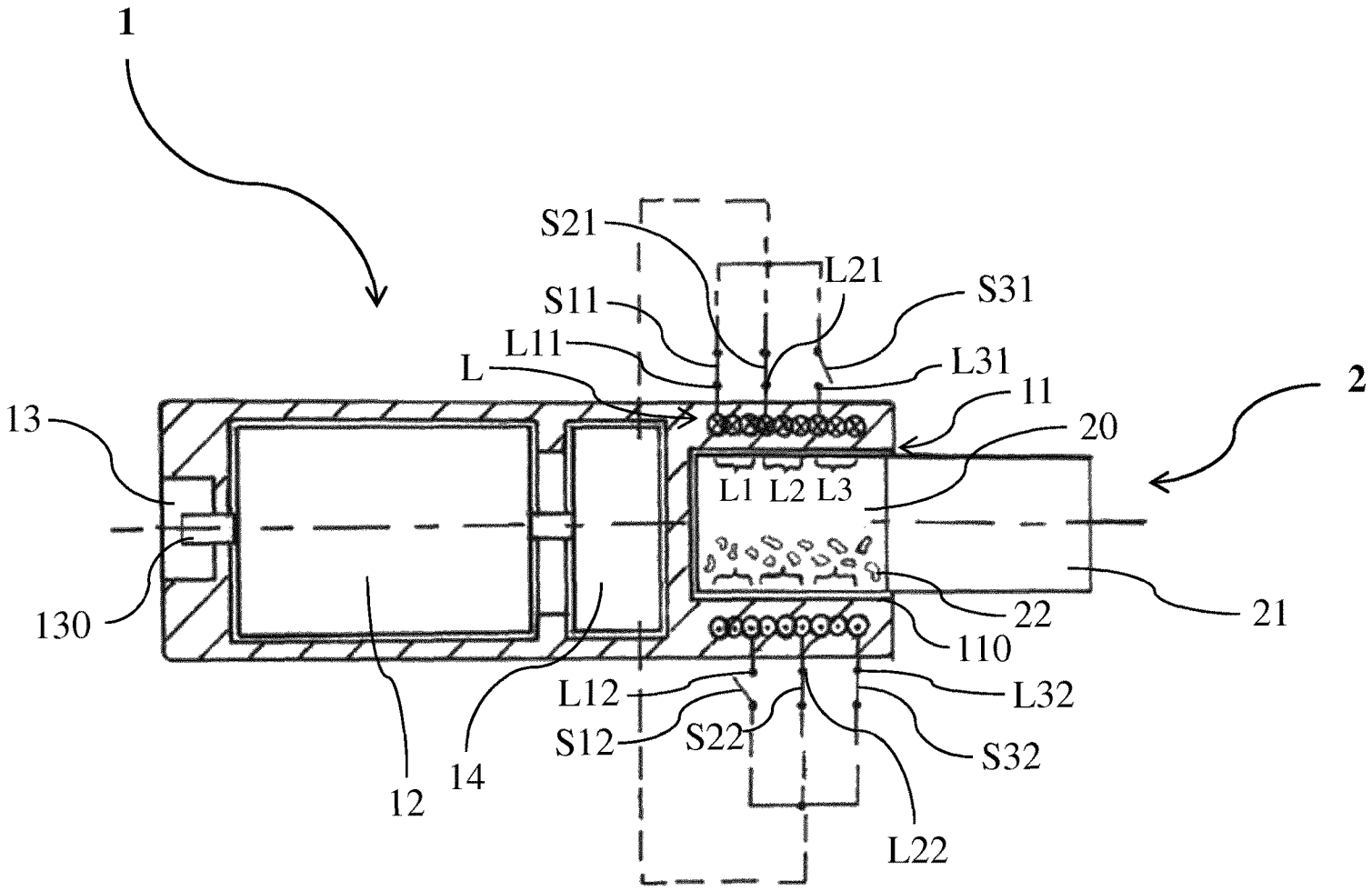
FIG. 1 shows a first embodiment of an inductive heating device and aerosol delivery system according to the invention without mouthpiece.

FIG. 1 shows a first embodiment of an inductive heating device 1 according to the invention with an aerosol-forming article 2 arranged in a cavity 11 of the device housing 10 of inductive heating device 1, the inductive heating device 1 and the aerosol-forming article 2 together forming an aerosol delivery system according to the invention. As shown in FIG. 1, the aerosol-forming article 2 may comprise a solid tobacco-laden substrate 20 and a filter portion 21, however, this is by way of example only rather than being mandatory. As can be seen further in FIG. 1, the solid tobacco-laden substrate 20 comprises susceptor particles 22 which are distributed in the tobacco-laden substrate 20 but are depicted in FIG. 1 in the lower half of tobacco-laden substrate 20 only. As mentioned already, the aerosol-forming article 2 may have the shape of a rod, with the internal surface 110 of the cavity 11 being sized and shaped to accommodate the rod of tobacco-laden substrate 20.

A single helically wound inductor coil L is also shown in FIG. 1 which is arranged to surround cavity 10 to be capable of inducing an alternating magnetic field within cavity 10. Inductor coil L comprises a plurality of individual coil segments, with three such individual coil segments L1, L2 and L3 being shown. Each individual coil segment comprises two connection taps, for example coil segment L1 comprises two connection taps L11 and L12, coil segment L2 comprises two connection taps L21 and L22, and coil segment L3 comprises two connection taps L31 and L32. These connection taps L11, L21, L31, L12, L22, L32 are arranged at different locations along the length l of coil L, this being indicated in FIG. 1 only schematically, as the connection taps are of course arranged in the device housing 10, as are the connections between the power supply electronics and the connection taps (as is discussed in more detail below).

Inductive heating device 1 further comprises an electrical power source 12, which may be a DC power source such as a battery (e.g. a rechargeable battery). A docking port 13 comprising a pin 130 for recharging the battery is also indicated in FIG. 1 by way of example.

Inductive heating device 1 further comprises a power supply electronics 14 connected to the electrical power source 12 (rechargeable battery) on one hand and to coil L on the other hand. Power supply electronics 14 is capable of supplying an alternating current to the connection taps of the individual coil segments L1, L2 and L3. This is schematically indicated by the dashed connection lines and switches S11, S21, S31, S12, S22, S32 which are illustrated in FIG. 1 for better understanding only. In practice, the electrical connections are arranged within device housing 10, and since the power supply electronics 14 may typically comprise a microcontroller unit (not shown in detail), the supply of alternating voltage/current to the respective signal outlets of the microcontroller unit can be "switched" within the microcontroller unit and directly supplied to the respective signal outlets of the microcontroller unit which can be directly connected to the respective connection taps L11, L12, L13, L12, L22, L32 of the individual coil segments.

Figure 2:
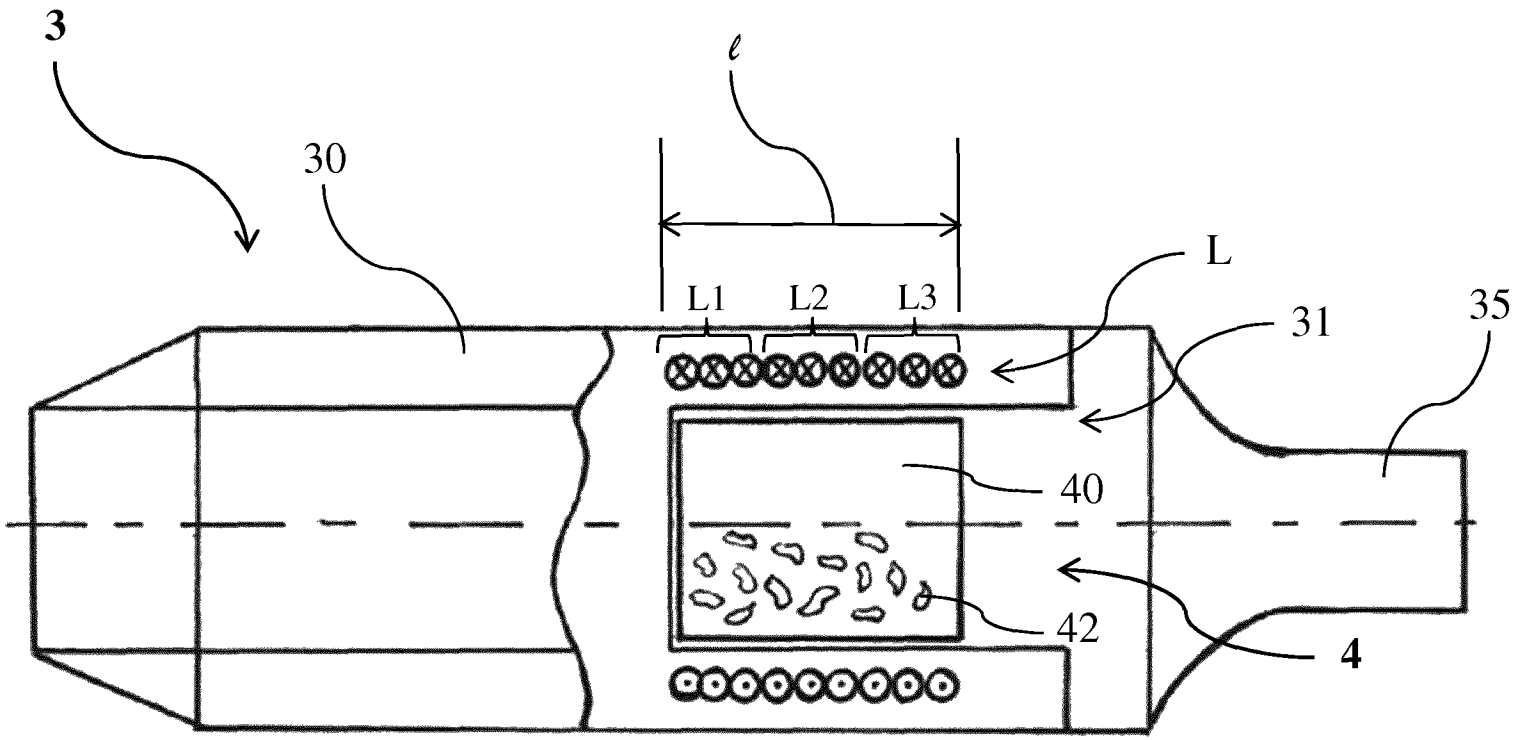
FIG. 2 shows a second embodiment of an inductive heating device and system according to the invention with mouthpiece.

FIG. 2 shows a further embodiment of the inductive heating device 3 according to the invention. However, FIG. 2 only very schematically shows this further embodiment of the inductive heating device according to the invention, as many components that have been described in connection with the embodiment of FIG. 1 can be present in the embodiment of FIG. 2 as well, so that they need not be described in detail again. An essential difference of the embodiment of the inductive heating device 3 of FIG. 2 vis-a-vis the embodiment of the inductive heating device 1 of FIG. 1 is that the embodiment of FIG. 2 comprises a mouthpiece 35 whereas the embodiment of FIG. 1 does not comprise such mouthpiece. Accordingly, inductive heating device 3 comprises a device housing 30 comprising a cavity 31 in which a rod of solid tobacco-laden substrate 40 (here: without filter) of an aerosol-forming article 4 is arranged. The solid tobacco-laden substrate 40 again comprises susceptor particles 42 distributed within the solid tobacco-laden substrate 40, these susceptor particles 42 again being illustrated only in the lower half of the tobacco-laden substrate 42. Coil L is again arranged to surround cavity 31, with the individual coil segments again being indicated by reference signs L1, L2, L3. Again, the internal surface 310 of cavity 31 is sized and shaped to accommodate the rod of tobacco-laden substrate 40 of the aerosol-forming article 4.

Figure 3:
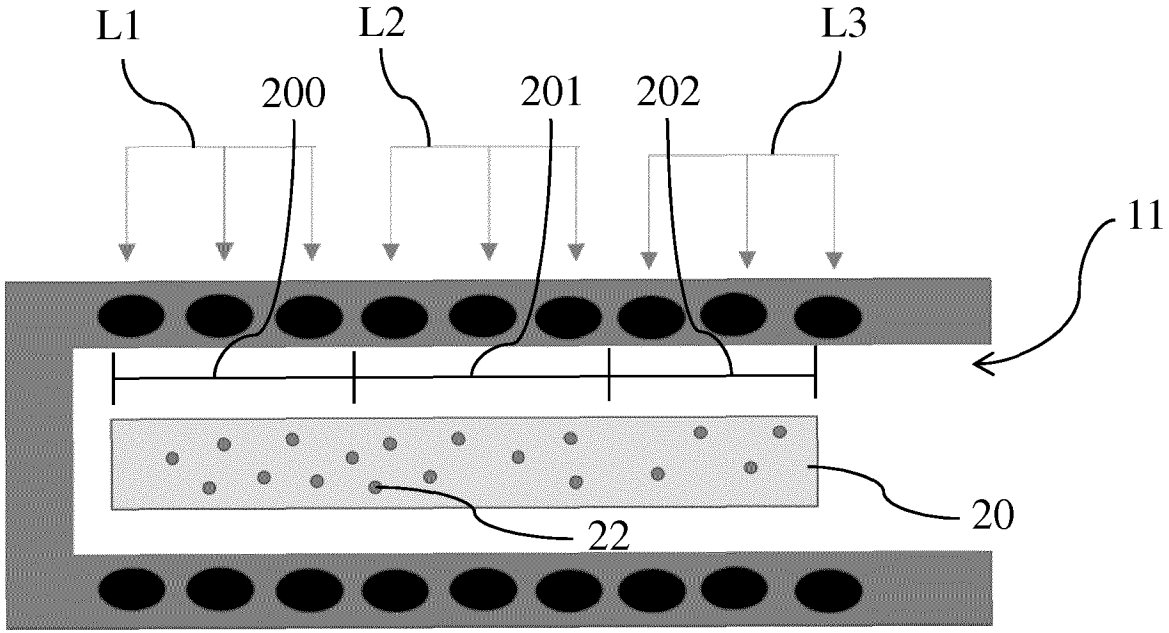
FIG. 3 shows a schematic representation of the cavity and the single coil comprising the individual coil segments and an aerosol-forming article comprising susceptor particles.

FIG. 3 shows in more detail cavity 11 of the embodiment of the inductive heating device 1 shown in FIG. 1, with only the rod of solid tobacco-laden substrate 20 being shown and arranged in cavity 11 of device housing 10, and with coil L surrounding the tobacco-laden substrate 20 containing the susceptor particles 22. Similarly, the following description of FIG. 3 and FIG. 4 also holds for cavity 31 of the embodiment of the inductive heating device 3 shown in FIG. 2. The three coil segments L1, L2, L3 are indicated through the respective groups of arrows representing the individual coil segments L1, L2, L3.

Figure 4:
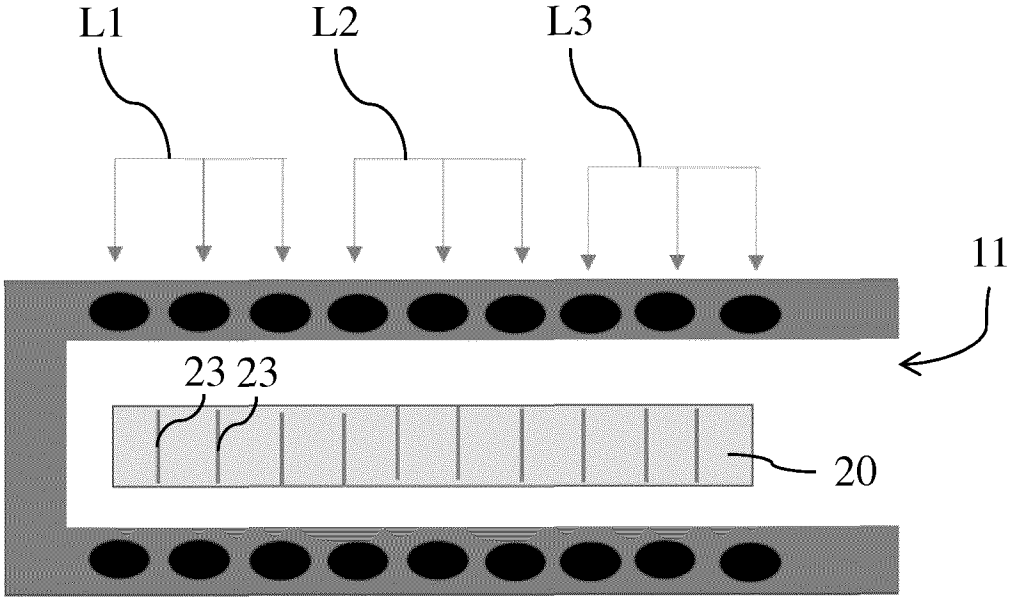
FIG. 4 shows a schematic representation of the cavity and the single coil comprising the individual coil segments and an aerosol-forming article comprising susceptor strips.

FIG. 4 also shows in more detail cavity 11, with coil L being arranged to surround cavity 11 in which tobacco laden substrate 20 is arranged. However, different from the embodiment shown in FIG. 3, tobacco-laden substrate 20 comprises susceptor strips 23 which are arranged equidistantly spaced along the length of the rod of tobacco-laden substrate 20. The susceptor strips 23 extend in a direction generally transverse to, in the embodiment shown perpendicular to, the length of the rod of tobacco-laden substrate 20.

Operation of the inductive heating device and aerosol delivery system according to the invention is described in the following.

As has been mentioned further above, the various segments L1, L2, L3 of coil L are individually supplied with an alternating current. For the sake of simplicity, let us assume that the individual coil segments L1, L2, L3 are supplied by first supplying coil segment L1, thereafter supplying coil segment L2, and then supplying coil segment L3 with the alternating current. For that purpose, a direct current (DC) drawn from battery 12 is converted into an alternating current (AC) by power supply electronics 14 which may contain a DC/AC inverter for that purpose. The alternating current is then sequentially supplied to the individual coil segments L1 (first), L2 (second), L3 (third). However, any other sequence of supplying the alternating current to the coil segments L1, L2, L3 is considered to be within the scope of the invention as well. Also, as already mentioned further above, the time intervals during which the individual coil segments L1, L2 as well as L2, L3 are supplied with alternating current may overlap, so that for a certain overlapping time interval both coil segments L1 and L2 may be simultaneously supplied with alternating current before supply of alternating current to coil segment L1 is discontinued (and alternating current is supplied to coil segment L2 only). Similarly, for a certain overlapping time interval both coil segments L2 and L3 are supplied with alternating current before the supply of alternating current to coil segment L2 is discontinued (and alternating current is supplied to coil segment L3 only).

By way of example only, in case the entire consuming run has a duration of six minutes, the first individual coil segment L1 of coil L may be supplied with the alternating current for two minutes. After these first two minutes the second individual coil segment L2 of coil L may be supplied with the alternating current for another two minutes (i.e. for the third and fourth minute counted from the start of the consuming run), and thereafter the third individual coil segment L3 is supplied with the alternating current for yet another two minutes (i.e. for the fifth and sixth minute counted from the start of the consuming run). The overlapping time interval (during which two adjacently arranged individual coil segments are both supplied with the alternating current) may have a duration of thirty seconds.

FIG. 1 shows a state in which the alternating current is supplied to coil segment L2 only. As switches S11 and S21 are both closed, the respective connection taps L11, L12 and L21 have the same voltage potential. Consequently, no alternating current flows through coil segment L1. Similarly, switches S22 and S32 are in the closed state, so that the respective connection taps L32, L31 and L22 have the same voltage potential. Consequently, no alternating current flows through coil segment L3, either. The alternating current flows through connection tap L21, through coil segment L2 and through connection tap L22.

As a consequence, an alternating magnetic field is generated by coil segment L2 only, thus heating up portion 201 (see FIG. 3) of the rod of solid tobacco-laden substrate 20 by generating heat in the susceptor particles 22 through hysteresis losses only, or through a combination of hysteresis losses and eddy current losses, depending on the type of material the susceptor particles 22 are made of Through this heating up, an aerosol is generated releasing the flavor which can be inhaled by the consumer through drawing at the filter 21 (or at the mouthpiece 35, respectively).

It is clear, that for heating up portion 200 (see FIG. 3) of the rod of solid tobacco-laden substrate 20 switch S11 is closed while S21 and S31 are both open, and all three switches S12, S22 and S32 are closed, so that the alternating current only flows through coil segment L1 while no current flows through coil segments L2 and L3. Similarly, for heating up portion 202 (see FIG. 3) of the rod of tobacco-laden substrate 20, switches S11, S21 and S31 and S32 are closed while switches S12 and S22 are open, so that the alternating current only flows through coil segment L3 while no current flows through coil segments L1 and L2.

Similar considerations hold for the embodiment of the rod of tobacco-laden substrate 20 comprising the susceptor strips 23 (FIG. 4), and for the embodiment of the inductive heating device shown in FIG. 2 in which the aerosol-forming article 4 comprising the rod of tobacco-laden substrate 40 is arranged within the cavity 31. (embodiment with mouthpiece).

Various embodiments of the inductive heating device, the aerosol-delivery system and the method of operating have been described above with the aid of the embodiments shown in the drawings. However, these embodiments have been described by way of example only, and various changes and modifications are possible without departing from the general teaching underlying the invention. Therefore, the invention is not limited to the embodiments described, but rather the scope of protection is defined by the appended claims.

The invention claimed is:

1. An inductive heating device for heating an aerosol-forming article comprising a susceptor, the inductive heating device comprising:

a device housing comprising a cavity having an internal surface shaped to accommodate at least a portion of the aerosol-forming article;

a coil arranged to surround at least a portion of the cavity;

an electrical power source; and power supply electronics connected to the electrical power source and to the coil to supply an alternating current to the coil to generate in the portion of the cavity surrounded by the coil an alternating magnetic field suitable to heat the susceptor, wherein the coil is a single coil having a coil length and a plurality of different individual coil segments which are sequentially arranged along the cavity, each of the individual coil segments having two connection taps which are arranged at different locations along the coil length, thereby dividing the single coil into the plurality of different individual coil segments, the connection taps being connected to the power supply electronics, and wherein the power supply electronics are configured to individually supply the alternating current to each individual coil segment of the plurality of different individual coil segments, to generate the alternating magnetic field in the portion of the cavity surrounded by the respective individual coil segment supplied with the alternating current.

2. The inductive heating device of claim 1, wherein the power supply electronics are configured to sequentially supply the alternating current to the individual coil segments in a same sequence the individual coil segments are arranged along the cavity.

3. The inductive heating device of claim 2, wherein the power supply electronics are configured to supply the alternating current to a preceding individual coil segment of the sequence and to thereafter supply the alternating current to a subsequent individual coil segment of the sequence, and wherein the power electronics are further configured to start supplying the alternating current to the subsequent individual coil segment of the sequence while continuing to supply the alternating current to the preceding individual coil segment of the sequence, so that there is an overlapping time interval during which the alternating current is supplied to both the preceding individual coil segment and the subsequent individual coil segment of the sequence.

4. The inductive heating device of claim 1, wherein the plurality of coil segments includes three of the individual coil segments.

5. The inductive heating device of claim 1, wherein all of the connection taps are arranged at different locations along the coil length.

* * * * *